US005263456A

United States Patent [19]

Owen-Evans

[11] Patent Number: 5,263,456

[45] Date of Patent: Nov. 23, 1993

[54] FUEL FLOW ARRANGEMENT

[75] Inventor: Alec Owen-Evans, Chelmsford, United Kingdom

[73] Assignee: Ford Motor Company, Dearborn, Mich.

[21] Appl. No.: 962,791

[22] PCT Filed: Jul. 3, 1991

[86] PCT No.: PCT/GB91/01077

§ 371 Date: Dec. 24, 1992

§ 102(e) Date: Dec. 24, 1992

[87] PCT Pub. No.: WO92/01150

PCT Pub. Date: Jan. 23, 1992

[30] Foreign Application Priority Data

Jul. 4, 1990 [GB] United Kingdom ..... 9014819

[51] Int. Cl.[5] ..... F02M 37/04

[52] U.S. Cl. ..... 123/495; 417/292; 123/514

[58] Field of Search ..... 123/510, 514, 495, 557; 417/413, 395, 292

[56] References Cited

U.S. PATENT DOCUMENTS

| | | | |
|---|---|---|---|
| 4,179,245 | 12/1979 | Fuller | 417/292 |
| 4,187,813 | 2/1980 | Stumpp | 123/510 |
| 4,502,450 | 3/1985 | Duprez | 123/514 |
| 4,730,704 | 3/1988 | Ohno | 417/292 |
| 5,070,849 | 12/1991 | Rich et al. | 123/514 |
| 5,197,443 | 3/1993 | Hodgkins | 123/514 |

*Primary Examiner*—Tony M. Argenbright
*Assistant Examiner*—Thomas Moutis
*Attorney, Agent, or Firm*—Jerome R. Drouillard; Roger L. May

[57] ABSTRACT

A fuel flow arrangement has a fuel feed line (14) for feeding fuel from a tank (10) to an engine (12) with a fuel injection pump (20) by means of a pump (18), and a fuel return line (16) for returning excess fuel from the engine to the tank. A bypass passage (21) with an orifice (22) provides a communication between the feed and return lines and a flow restriction (24) is provided in the return line. When the fuel pressure created by the pump (18) is low, at low temperatures, fuel entering the return line will be recycled through the orifice (22) to the engine to increase the temperature of the fuel feed to the engine, and at higher temperatures, the flow through the orifice (22) will be reversed.

11 Claims, 6 Drawing Sheets

FUEL FLOW ARRANGEMENT

FIELD OF THE INVENTION

This invention relates to a fuel flow arrangement for a combustion engine and in particular to a fuel flow arrangement for a diesel engine. Although the invention is particularly intended for use on a diesel engine, it may also be applied to a petrol engine.

BACKGROUND TO THE INVENTION

There is a continuing need for more accurate control of the combustion process in engines in order to minimise engine emissions. It is desirable to be able to feed fuel at a constant temperature to the engine as this can help to control the operation of the engine

SUMMARY OF THE INVENTION

According to the present invention, there is provided a fuel flow arrangement for a combustion engine, the arrangement comprising a fuel reservoir, a fuel feed line extending from the reservoir to the engine, a fuel return line extending from the engine to the reservoir, and a bypass passage which provides a communication between the feed and return lines, the arrangement also comprising a fuel lift pump which has the characteristic of increasing its pumping performance with increasing temperature and which is located in the feed line between the reservoir and the bypass passage, a fuel pressurization pump located between the engine and the bypass passage and fuel flow restrictions located both in the bypass passage and in the return line between the bypass passage and the reservoir.

Because the lift pump works at different efficiencies at different temperatures, the relative pressures created by the two pumps will vary over a range of ambient temperatures. At low temperatures when the lift pump is working inefficiently there will be a relatively high rate of recirculation flow through the bypass passage so that a large proportion of the fuel which has been presented to the pressurization pump (located close to the engine), and has therefore been warmed, is recirculated to the engine. On the other hand, at high ambient temperatures when the lift pump is working at greater efficiency, there is an opposite flow through the bypass passage and the fuel presented to the engine is drawn entirely from the reservoir which represents cooler fuel than that recirculated from the pressurization pump.

The lift pump is preferably a diaphragm pump in which the diaphragm material becomes stiffer at lower temperatures and this results in the lift pump having the characteristic of increasing its pumping performance with increasing temperature. The relevant temperature is the temperature of the fuel which is passing through the pump. The fuel comes in contact with the pump diaphragm so that the temperature of the diaphragm itself moves towards the fuel temperature. Before the engine is started, the temperature of the fuel is determined by the ambient temperature.

A suitable material for the diaphragm is a nitrile rubber/cotton compound. On a diesel engine, the lift pump will preferably be a mechanical lift pump.

In a diesel engine the fuel is fed by the mechanical lift pump to a fuel pressurization pump in the form of an injection pump. The fuel injection pump passes a proportion of the fuel it receives to the fuel injectors and recirculates the excess fuel along the fuel return line.

The fuel flow restrictions may take the form of orifices, or they may be simple check valves which open at a preset fluid pressure to allow fuel to pass. The restriction in the bypass passage is preferably a simple orifice. It may be desirable to give the flow restriction in the return line a progressive characteristic, for example by using a spring with a variable spring rate to control a check valve, in order to optimise the performance.

The size of the orifice in the bypass passage will depend on the nature of the engine to which it is fitted. However for a 2.5 liter direct injection diesel engine, a suitable orifice size has been found to be 4 mm and tests have shown that the size of this orifice may vary between 1 mm and 8 mm.

In a diesel engine, the fuel feed line includes a filter, and the fuel return line can be arranged so that it passes through the filter housing, and in this case the bypass passage and its orifice, and the flow restriction in the return line, can all be incorporated in the filter housing.

BRIEF DESCRIPTION OF THE DRAWINGS

The invention will now be further described, by way of example, with reference to the accompanying drawings, in which.

DETAILED DESCRIPTION OF PREFERRED EMBODIMENTS

Figure 1:
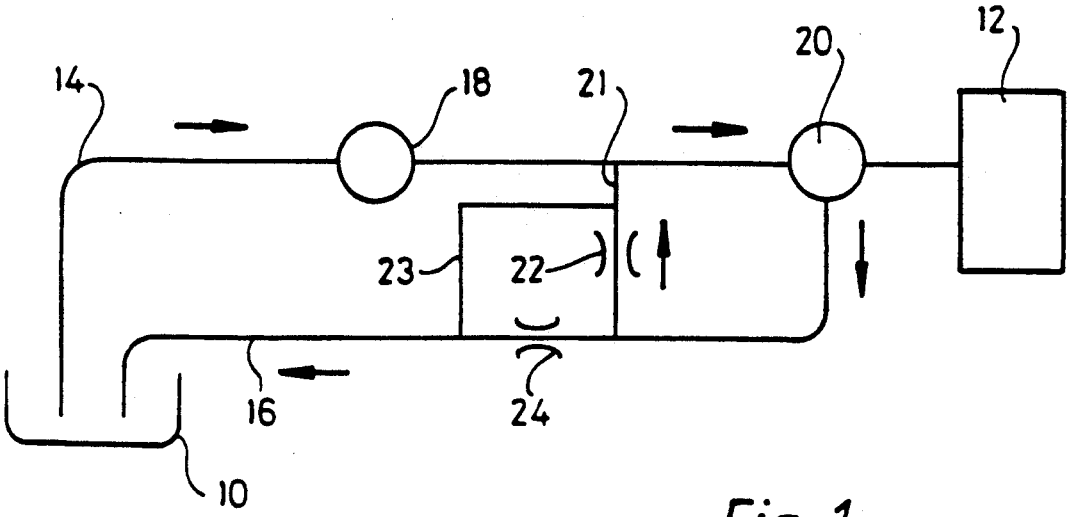
FIG. 1 is a schematic simplified diagram of a fuel flow arrangement in accordance with the invention showing the fuel flow direction at low ambient temperatures.
Figure 2:
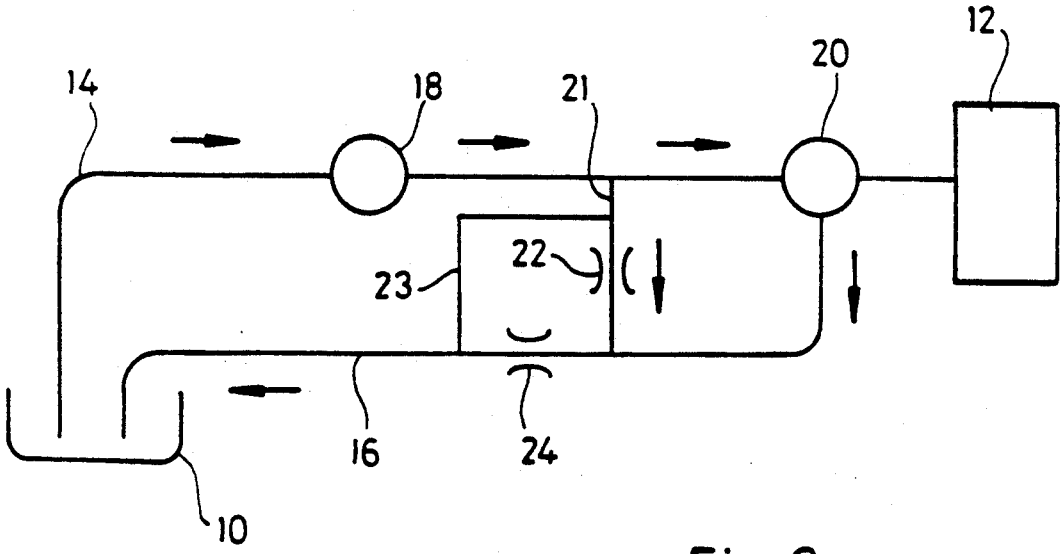
FIG. 2 is a schematic simplified diagram of a fuel flow arrangement in accordance with the invention showing the fuel flow direction at high ambient temperatures.

FIGS. 1 and 2 show a fuel tank 10 and an engine 12 with a fuel injection pump 20. A fuel feed line 14 and a fuel return line 16 both extend between the tank and the injection pump and a fuel lift pump 18 in the feed line 14 pumps fuel to the injection pump. The lift pump may be an in-tank pump mounted inside the tank 10, at the beginning of the feed line. The fuel injection pump takes what fuel is needed at that moment for the running of the engine 12, and the excess fuel is pumped into the return line 16.

In a conventional system, once fuel enters the return line 16, it passes directly to the fuel tank 10. This is disadvantageous in diesel engines in particular but in petrol engines also, under cold ambient conditions. In cold conditions, fuel is always being drawn from the store of cold fuel in the tank and this leads to inefficient engine operation.

It is known that the engine will operate most efficiently when the temperature of the fuel fed to it lies within a relatively narrow range. By providing a bypass passage 21 with an orifice at 22 between the feed and return lines and a flow restriction in the form of a check valve at 24, significant benefits can result. An air bleed passage 23 is also provided. The result of the inclusion of these additional components is set out in the following.

At low temperatures, the volume of fuel actually pumped by the lift pump 18 will be relatively low because the pump is working inefficiently. The fuel pressure created between the pump 18 and the pump 20 will therefore be low. However the pressure created downstream of the injection pump will be relatively high, and the imbalance of pressures across the ends of the bypass passage 21 will cause a flow to take place from the return line to the feed line as indicated in FIG. 1. As a result some of the fuel which enters the return line 16 will pass through the orifice 22 and back into the feed line where it will be recirculated to the engine. The advantage of this is that the fuel which enters the return line has been warmed by passage through the pump 20 which is close to the engine and this volume of warmed fuel will add to the rest of the fuel in the feed line to provide a feed of warmed fuel to the engine. If there should be any air trapped in the recirculating fuel, then this will be able to escape via the bleed passage 23.

On the other hand, when the ambient temperature is high the pressure created by the lift pump 18 will be high relative to that created in the return line by the injection pump 20 and the imbalance of pressures across the return line will be opposite to that indicated in FIG. 1. As a result, flow will take place through the bypass passage from the feed line to the return line as shown in FIG. 2, and none of the warmed fuel will be recycled to the engine which will thus be fed with relatively cool fuel direct from the tank. The warmed fuel will all be returned to the tank where it will be cooled by mixing with the bulk of fuel there.

The size/flow resistance of the restrictions 22 and 24 will be chosen to ensure that the flow reversal, that is the changeover of the flow direction in the bypass passage, takes place at the desired point, having regard to the optimum fuel temperature to be fed to the engine and the characteristics of the pumps.

Figure 3:
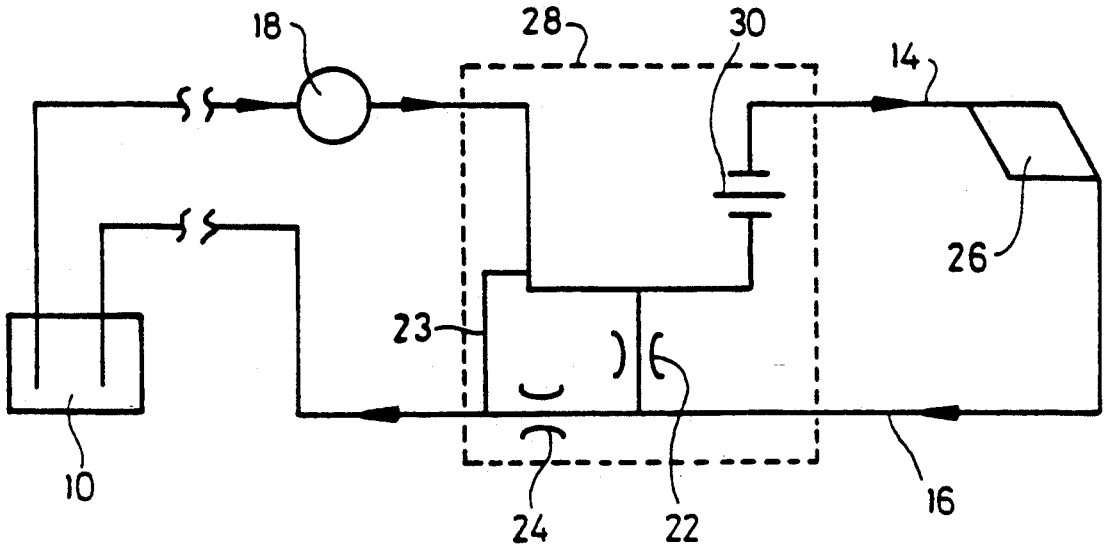
FIG. 3 is a diagram of a second embodiment of the invention, particularly for use with a diesel engine.

FIG. 3 shows this principle applied to a diesel engine. The fuel injection pump 26, and both the feed line 14 and the return line 16 pass through the housing 28 of a fuel filter unit. The passage of the fuel feed line through the filter unit is indicated at 30.

Figure 4:
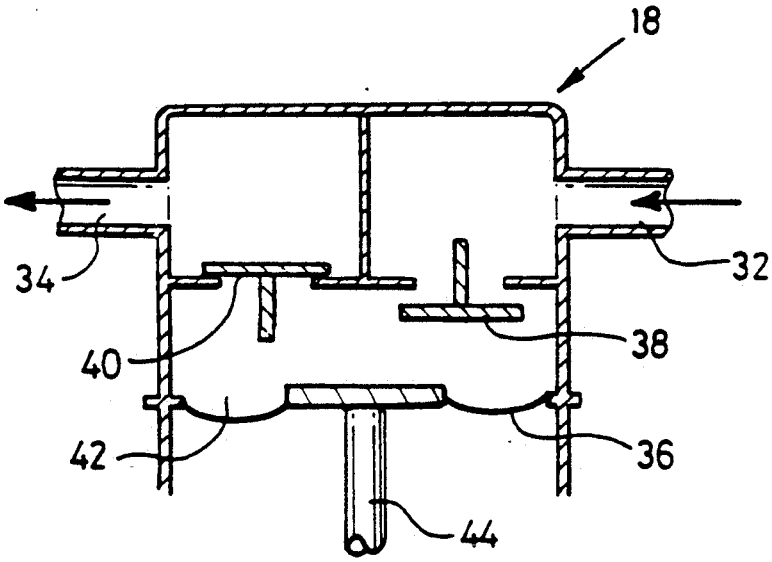
FIG. 4 illustrates the manner of operation of a mechanical lift pump for use in the arrangement of the invention.

FIG. 4 shows a suitable mechanical lift pump 18 for use in the invention. The lift pump has an inlet 32 and an outlet 34. A flexible diaphragm 36 operates in a pump chamber beneath an inlet valve 38 and an outlet valve 40. When the diaphragm 36 is pulled down, the valve 38 is pulled open and fuel is sucked in through the inlet 32 into the chamber 42. On an upward stroke of the diaphragm, the outlet valve 40 is opened and fuel is forced out through the outlet 34.

The diaphragm can be moved up and down by arranging an operating stem 44 so that it is in contact with a cam, with a spring (not shown) keeping the stem in contact with the cam to produce reciprocating motion of the stem as the cam rotates.

The material of the diaphragm 36 itself will be a flexible material. As is the case with many rubber or rubber-like materials, the flexibility will vary with temperature. At low temperatures the diaphragm will become stiffer and the efficiency, i.e. the volume of fluid pumped, will be less than at higher temperatures when the diaphragm is softer.

Figure 5:
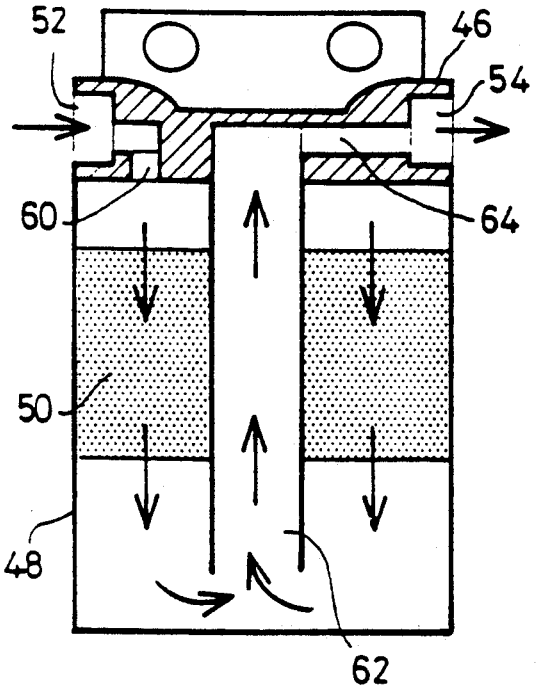
FIG. 5 is a section through a fuel filter for use in the invention, on the lines IV—IV from FIG. 7.
Figure 6:
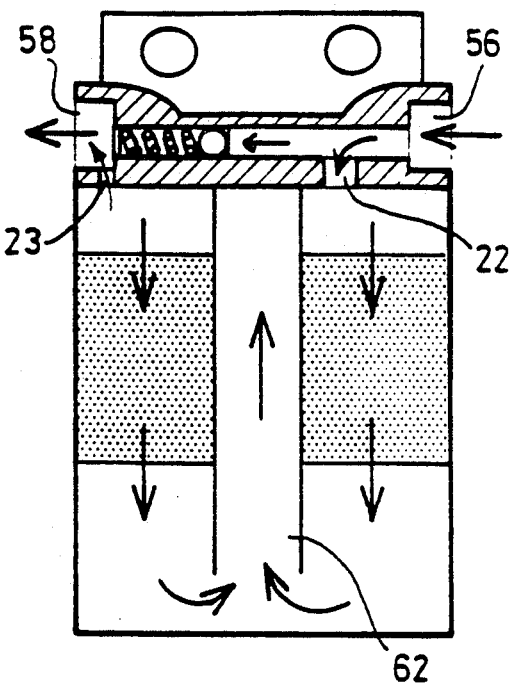
FIG. 6 is a section through the fuel filter on the lines V—V from FIG. 7.
Figure 7:
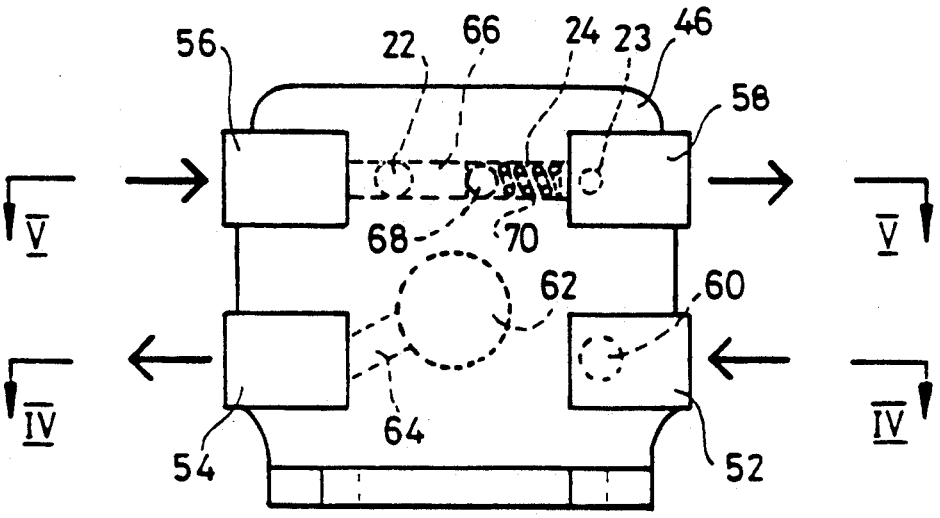
FIG. 7 is a plan view of the filter.

The construction of the filter unit 28 in which the orifice 22 and the restriction 24 are contained is described in more detail with reference to FIGS. 5, 6 and 7.

The filter unit has a head 46 to which the fuel lines are connected, and a filter element 48. As is conventional, the filter element itself is detachable from the head 46. The filter element includes a body 50 of filter material. As can be seen from FIGS. 5 and 6, the head 46 of the filter has an inlet connection 52 for the fuel feed line, an outlet connection 54 for the fuel feed line, an inlet connection 56 for the fuel return line and an outlet connection 58 for the fuel return line. Looking now at FIG. 5, the incoming fuel is directed through a passage 60 into the filter material 50, and passes through the filter material and then back up through a tube 62 in the centre of the filter element 48. This tube 62 leads into a passage 64 in the head and thence to the outlet connection 54. This therefore amounts to a simple filtering operation. The filtered fuel leaving the filter unit through the connection 54 passes to the engine. It is also possible for the fuel from the feed line to pass directly from the passage 60 to the orifice 22, across the top of the filter material 50.

The returning fuel enters the filter unit at 56. The fuel flow then has two choices; firstly it can flow through the orifice 22 into the space above the filter material 50. The fuel which follows this path passes through the filter material and then up through the tube 62 to leave the filter unit through the feed line outlet connection 54. Secondly it can follow an alternative path for fuel from the return line along a straight-through bore 66 and past a check valve 24. The check valve consists of a ball 68 loaded by a spring 70. If the fuel pressure is sufficient to overcome the force of this spring, then the valve will open so that the fuel can flow to the outlet connection 58 and from there back to the tank.

The characteristics of the spring 70 are to be chosen in accordance with the characteristics of the lift pump diaphragm 36 to ensure that the desired fuel flow pattern is achieved, preferably over a temperature range from −20° C. to +30° C.

Figure 8:
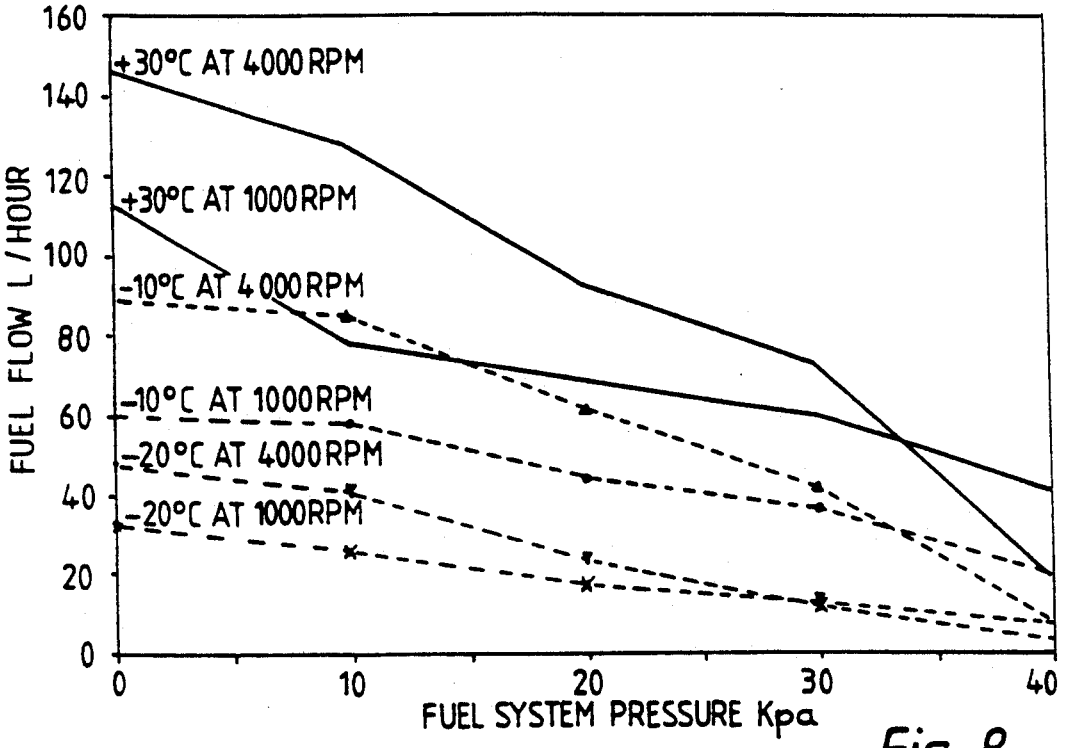
FIGS. 8, 9 and 10 are graphs on which fuel system pressure is plotted against fuel flow.
Figure 9:
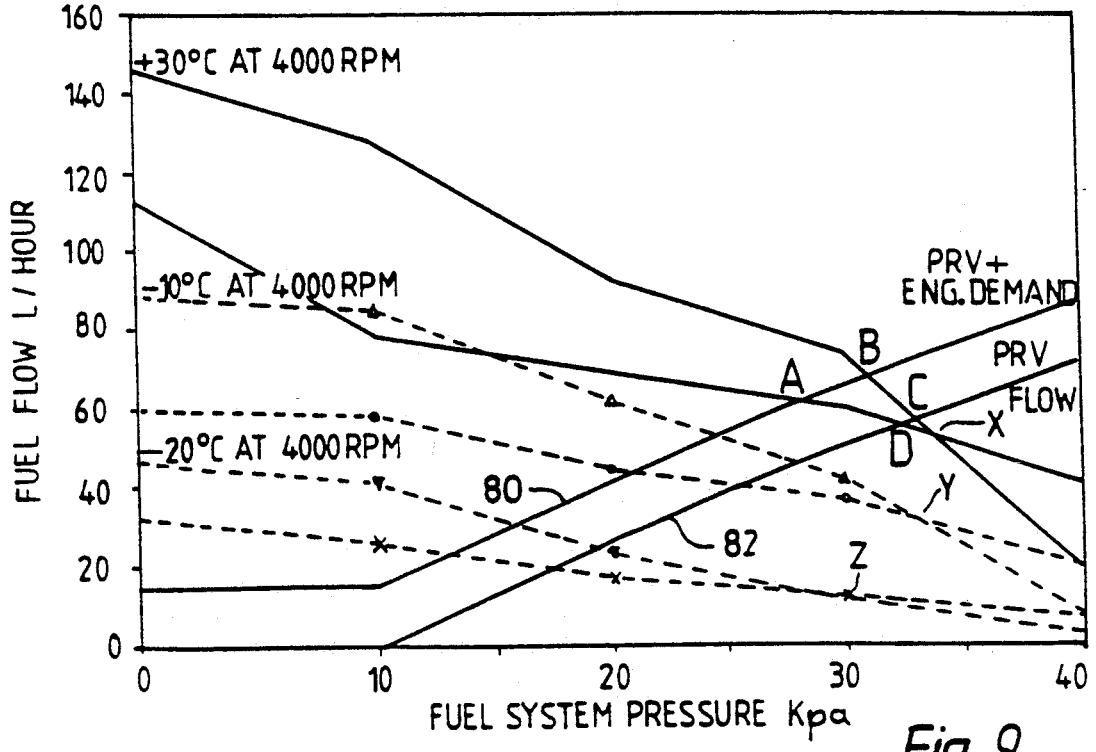
Figure 10:
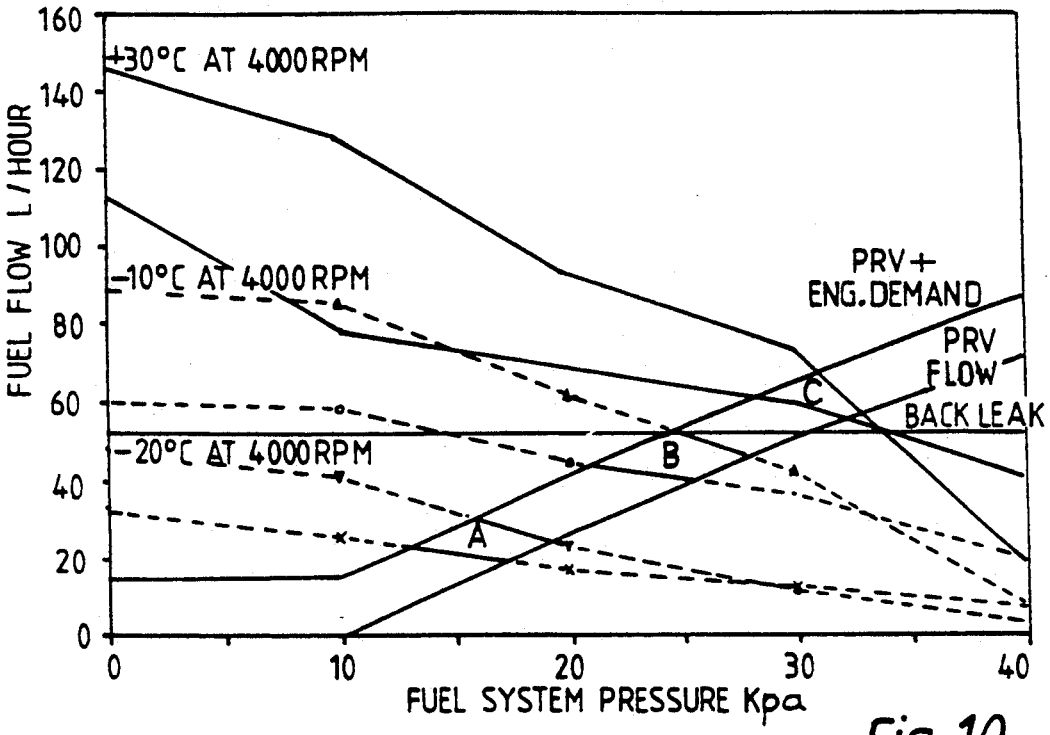

The graphs of FIGS. 8, 9 and 10 illustrate the performance of the lift pump 18. Pressure versus flow characteristics are shown for varying fuel temperatures. For example, at +30° C. fuel temperature, the operating band of the lift pump is defined at 1000 and 4000 rpm. As fuel temperature decreases, fuel delivery decreases for a given system pressure.

This change in performance is due to stiffening of the mechanical lift pump diaphragm (a material effect and not a viscosity effect) as temperatures fall, and it is this characteristic which is used to control the fuel recirculation in the filter head assembly.

In FIG. 9, two additional lines are superimposed on the graph of FIG. 8. These lines are indicated by the reference numerals 80 and 82. The line 80 represents the flow through the pressure relief valve 24, and the line 80 represents the sum of the flow through the pressure relief valve 24 and the fuel demand of the engine. With these lines overlaid on the graph of FIG. 8, we can now define an envelope within which the engine/system will operate for a given fuel temperature. For example, between no load (1000 rpm) and full load (4000 rpm)

operation at 30° C., the pressure and flow variation will be within the area bounded by the points A-B-C-D.

Two conclusions can be drawn from the graph of FIG. 9. Firstly the position of the cross-over point X, Y, Z will vary with fuel temperature, and secondly within the speed and load range the further away from this point you operate, the greater the flow and pressure variation likely within the system for a given fuel temperature. The characteristics of the pressure release valve 24 should ideally be set to follow points X, Y, Z on the graph. However in reality this may not be possible due to constraints on the design of the pressure release valve.

FIG. 10 shows the fuel injection pump backleak flow overlaid. It is now possible to demonstrate how automatic fuel temperature control can be achieved.

The backleak or return flow from the fuel injection pump is substantially independent of temperature or system pressure. If the backleak flow is greater than the allowable return flow to the tank 10 through the pressure relief valve 24 (fuel flow back to tank through the valve 24 is primarily dependent on the system pressure) then the difference between the two flows will flow back into the filter head through restriction 22. This is how fuel heating is achieved. This is illustrated diagrammatically in FIG. 12.

The amount of recirculation can be controlled by varying the size of the restriction 22 for a given pressure relief valve characteristic. A 4 mm diameter orifice has been chosen for the restriction 22 for a 2.51 direct injection diesel engine.

As the fuel temperature increases with an associated improvement in the flow performance of the lift pump 18, a point will be reached where the pump lift flow will match and then exceed the backleak flow from the fuel injection pump 26. At this point, indicated by arrow F in FIG. 12, a flow reversal takes place and no further recirculation of hot fuel is possible.

This is demonstrated in FIG. 10 by following the performance envelopes A-B-C from −20° C. to +30° C. This graph also shows that at 4000 rpm full load the changeover from fuel heating to fuel cooling will occur at just below −10° C. The cloud point of the fuel should be used as a reference for selecting the changeover point from fuel heating to fuel cooling.

At this stage fuel flow through the restriction 22 is in the direction shown in FIG. 2. As fuel drawn from the tank is recirculated through the orifice 22 and back to the tank along the line 16, it acts as a cooling medium when it mixes with the hot fuel returning to the tank from the pump 20, and this results in a nett reduction in fuel temperature. Once this steady state has been reached, fuel temperature reduction is now controlled by heat rejection through the fuel tank walls.

Figure 12:
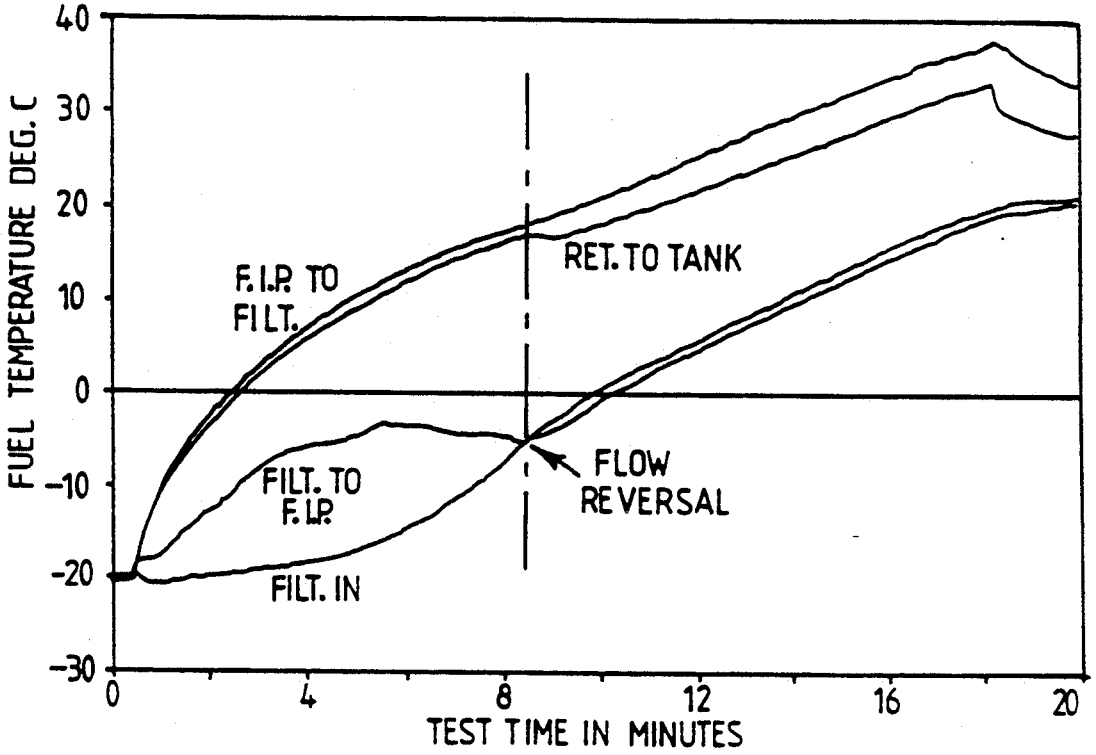
FIG. 12 is a graph similar to FIG. 11 but showing results from an arrangement according to the invention.

The performance curve shown in FIG. 12 demonstrates the transition from recirculating flow to cooling flow. This also identifies the point at which steady state air venting occurs. The test was conducted on a Ford 2.5 di engine rated at 80 ps with an initial temperature of −20° C. The engine was run at a constant 4000 rpm no load condition.

Figure 11:
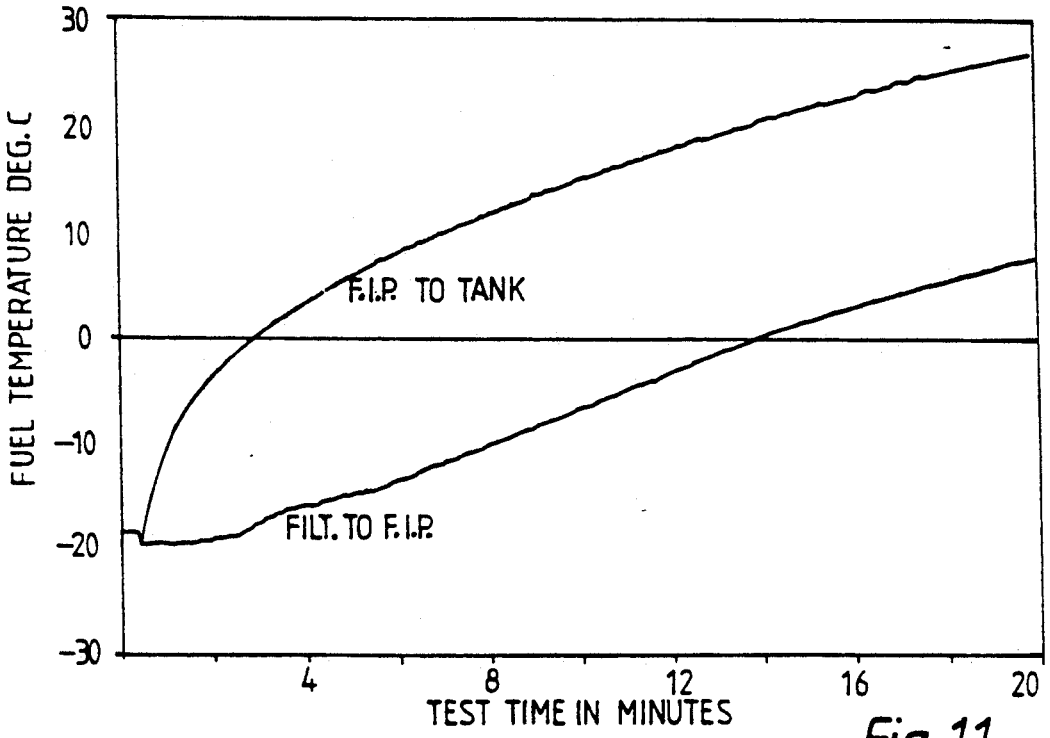
FIG. 11 is a graph showing fuel temperature against time in a prior art arrangement.

For comparison purposes, FIG. 11 shows the same system but without the recirculation passage 21, and it will be seen that the temperature of the fuel passing from the filter to the fuel injection pump only rises slowly and reaches a temperature of −10° C. after about eight minutes whereas in FIG. 12, this same fuel temperature is reached after about three minutes. As can be seen, a 4 mm orifice 22 gives about 50% fuel recirculation with the flow reversal taking place at −5° C. fuel temperature. The fuel temperature at which this flow reversal takes place can be changed as required by suitable selecting the lift pump 18 and the pressure relief valve 14.

FIG. 12 also shows how the return fuel to tank is cooled once the flow reversal has taken place, this being an added benefit for hot climate performance.

The invention provides a very simple method of self regulation by the fuel flow arrangement which will ensure that the fuel fed to the engine is at the correct temperature by suitably directing warm returned fuel from the engine and cold fuel from the tank. At the same time, because of the use of a mechanical lift pump there is a much reduced risk of air being entrained in the fuel feed and also the pressure differential across the fuel injection pump is kept to a minimum which allows more stable performance.

I claim:

1. A fuel flow arrangement for a combustion engine, the arrangement comprising a fuel reservoir, a fuel feed line extending from the reservoir to the engine, a fuel return line extending from the engine to the reservoir, and a bypass passage which provides a communication between the feed and return lines, the arrangement also comprising a fuel lift pump which has the characteristic of increasing its pumping performance with increasing temperature and which is located in the feed line between the reservoir and the bypass passage, a fuel pressurization pump located between the engine and the bypass passage and fuel flow restrictions located both in the bypass passage and in the return line between the bypass passage and the reservoir.

2. A fuel flow arrangement as claimed in claim 1, wherein the pump is a diaphragm pump in which the diaphragm material becomes stiffer at lower temperatures.

3. A fuel flow arrangement as claimed in claim 2, wherein the pump diaphragm is made from a rubber-based material.

4. A fuel flow arrangement as claimed in claim 1 applied to a diesel engine, wherein the pump is a mechanical lift pump.

5. A fuel flow arrangement as claimed in claim 1, wherein the fuel flow restriction in the return line takes the form of a check valve which opens at a preset fluid pressure to allow fuel to pass.

6. A fuel flow arrangement as claimed in claim 5, wherein the check valve has a spring with a variable spring rate to control the check valve.

7. A fuel flow arrangement as claimed in claim 1, wherein the fuel flow restriction in the bypass passage is an orifice.

8. A fuel flow arrangement as claimed in claim 7, wherein the orifice has a diameter of between 1 mm and 8 mm.

9. A fuel flow arrangement as claimed in claim 1, including a filter, and wherein the fuel return line is arranged so that it passes through the filter housing, and wherein both fuel flow restrictions are incorporated in the filter housing.

10. A fuel flow control unit for incorporation in a flow arrangement as claimed in claim 1, the unit comprising two parallel throughflow passages for fuel, a bypass passage which provides a communication between the two passages, a flow restriction in the bypass passage and a flow restriction in one of the throughflow passages.

11. A control unit as claimed in claim 10, including a fuel filter in the throughflow passage which does not contain the flow restriction.

* * * * *